United States Patent [19]

Reedy

[11] Patent Number: 5,013,961

[45] Date of Patent: May 7, 1991

[54] COMMON GROUND TERMINAL FOR USE WITH SINGLE FILAMENT AND DUAL FILAMENT WEDGEBASE LAMP BULBS

[75] Inventor: Patrick J. Reedy, Youngstown, Ohio

[73] Assignee: General Motors Corporation, Detroit, Mich.

[21] Appl. No.: 342,208

[22] Filed: Apr. 24, 1989

[51] Int. Cl.[5] ..... H01J 5/50

[52] U.S. Cl. ..... 313/318; 439/619

[58] Field of Search ..... 313/318; 439/617, 619, 439/611, 232, 242, 243

[56] References Cited

U.S. PATENT DOCUMENTS 4,720,272 1/1988 Durand ..... 439/619

4,883,434 11/1989 Toyoshima ..... 439/619

*Primary Examiner*—Sandra L. O'Shea

*Assistant Examiner*—Diab Hamadi

*Attorney, Agent, or Firm*—F. J. Fodale

[57] ABSTRACT

A common ground terminal is adapted for use with wedgebase lamp bulbs of either the single filament of dual filament type in a single filament lamp socket. The common ground terminal has a pair of opposed, upper and lower spring contact arms which biasingly engage opposite sides of a wedgebase when it is inserted into the space between the spring contact arms. The lower spring contact arm has a second spring tab which accommodates the presence of a second contact wire when the dual filament type of wedgebase lamp bulb is used.

2 Claims, 3 Drawing Sheets

COMMON GROUND TERMINAL FOR USE WITH SINGLE FILAMENT AND DUAL FILAMENT WEDGEBASE LAMP BULBS

BACKGROUND OF THE INVENTION

This invention relates generally to electrical terminals and more specifically to electrical ground terminals for use with wedgebase lamp bulbs.

Wedgebase lamp bulbs may be of the single or dual filament type. The single filament type has two contact wires for energizing the filament which emerge from the end of the wedgebase and extend over onto opposite flat sides of the wedgebase so that there is one contact wire adjacent each lateral side of the wedgebase.

On the other hand the dual filament type has two sets of contact wires for energizing the respective two filaments. These four contact wires emerge from the end of the wedgebase and extend over onto opposite flat sides of the wedgebase so that there is one contact wire on each flat side adjacent each lateral side of the wedgebase. This results in a contact area for the dual filament lamp bulb which is thicker than the contact area for the single filament lamp bulb by the thickness of one contact wire.

These two types of lamp bulbs are interchangeable in lamp bulb sockets in the sense that the dual filament lamp bulb can be used in a lamp socket designed for a single filament lamp bulb. In this case, the dual filament lamp bulb acts as a single filament lamp bulb. This interchangeability requires a common ground terminal which can be used with either the single filament lamp bulb with its two contact wires or the dual filament lamp bulb with its four contact wires.

In the past, these common ground terminals have had the drawback that the spring contact arms of the common ground terminal are deflected ore by the wedgebase of the dual filament lamp bulb because of the added thickness which is due to the presence of a second contact wire on the opposite side of the wedgebase in the vicinity of each lateral side. Consequently these known common ground terminals produce a contact force which varies considerably depending upon the type of wedgebase lamp bulb that is being used. Moreover these known common ground terminals cannot be designed for the optimum contact force with either type lamp bulb because optimizing the design for one type introduces the possibility of either exceeding the elastic limit of the terminal material or producing an inadequate contact force when the other type lamp bulb is used.

SUMMARY OF THE INVENTION

The object of this invention is to provide an improved common ground terminal for use with wedgebase lamp bulbs which has spring contact arms which are deflected so as to produce substantially the same contact force regardless of whether the single filament or the dual filament wedgebase lamp bulb is being used.

Another object of this invention is to provide an improved common ground terminal for use with wedgebase lamp bulbs which has opposed spring contact arms which are deflected substantially the same amount by the respective contact areas of the single filament and dual filament wedgebase lamp bulbs so that the terminal can be designed to produce an optimal contact force.

Yet another object of this invention is to provide an improved common ground terminal for wedgebase lamp bulbs in which one of the opposed spring contact arms is in the form of a compound spring which accommodates the absence of a second contact wire on the contact area of a wedgebase lamp bulb so that the opposed spring contact arms are deflected substantially the same amount by the wedgebases of single filament and dual filament lamp bulbs.

Other objects and features of the invention will become apparent to those skilled in the art as disclosure is made in the following detailed description of a preferred embodiment of the invention which sets forth the best mode of the invention contemplated by the inventors and which is illustrated in the accompanying sheet(s) of drawing.

DETAILED DESCRIPTION OF THE PREFERRED EMBODIMENT

Figure 1:
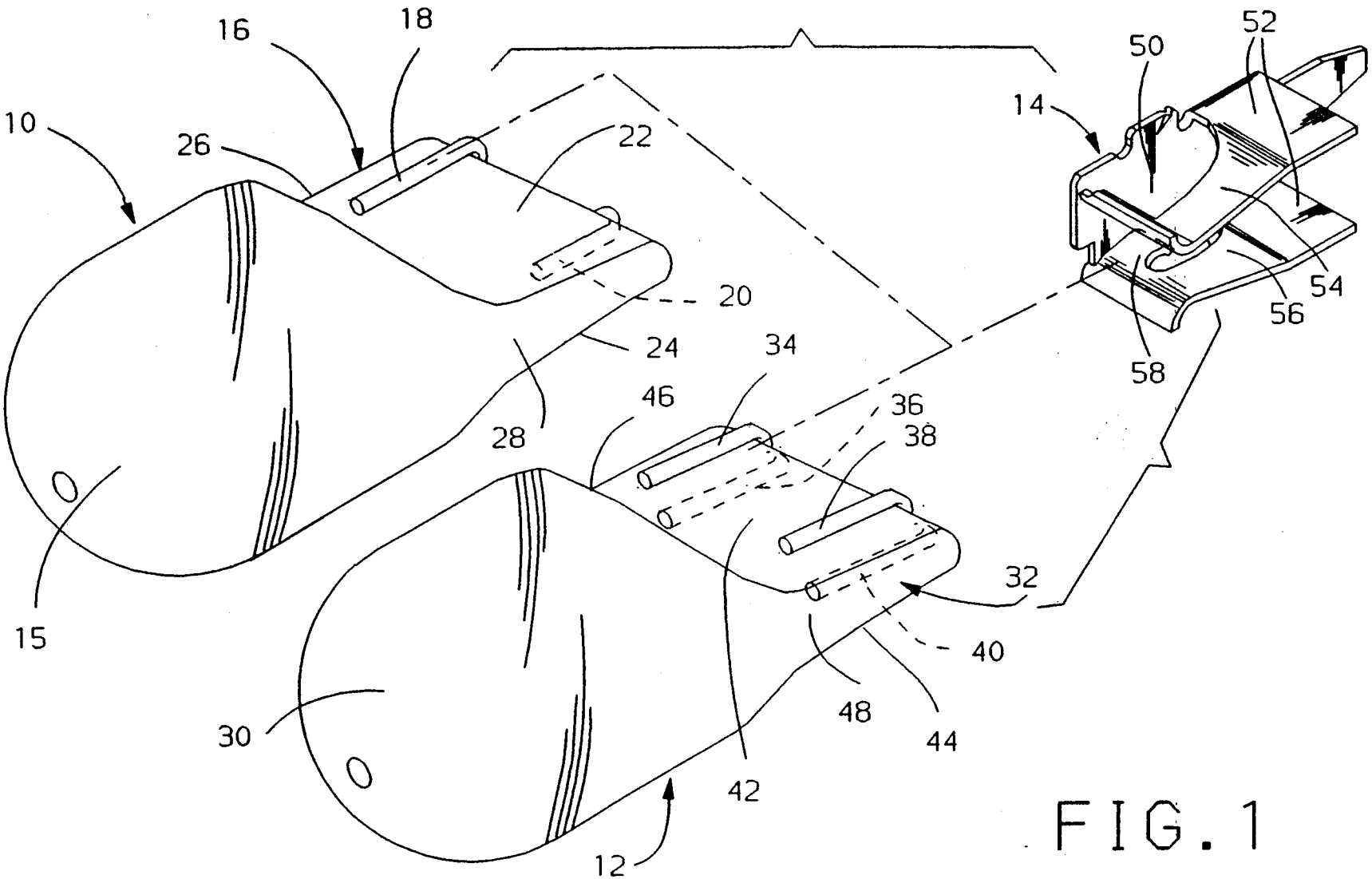
FIG. 1 is an exploded perspective view of a single filament wedgebase lamp bulb, a dual filament wedgebase lamp bulb and a common ground terminal for use with either of the wedgebase lamp bulbs in accordance with this invention.

Referring now to the drawing, FIG. 1 shows a single filament wedgebase lamp bulb 10, a dual filament wedgebase lamp bulb 12 and a common ground terminal 14 for use with either the lamp bulb 10 or the lamp bulb 12.

The single filament wedgebase lamp bulb 10 has an evacuated envelope 15 and a wedgebase 16. The lamp bulb 10 has a single filament (not shown) which is disposed inside the envelope 15 and energized by contact wires 18 and 20. These contact wires emerge from the end of the wedgebase 16 and extend over onto the respective upper and lower sides 22 and 24 of the wedgebase 16 near its opposite lateral ends 26 and 28.

The dual filament lamp bulb 12 has an evacuated envelope 30 and a wedgebase 32 which is the same size as the wedgebase 16 of the single filament lamp bulb 10. The lamp bulb 12 has two filaments (not shown) which are disposed inside the envelope 30 and energized by two sets or four contact wires 34, 36, 38 and 40 which emerge from the end of the wedgebase 32. One of the filaments is energized by contact wires 34 and 40 which extend over onto the respective upper and lower sides 42 and 44 of the wedgebase 32 near its opposite lateral ends 46 and 48. As mentioned above the wedgebase 16 and the wedgebase 32 are exactly the same size. Moreover the location of the contact wires 18 and 20 on the wedgebase 16 corresponds exactly to the location of the contact wires 34 and 40 on the wedgebase 32.

The second filament of the dual filament lamp bulb 12 is energized by the contact wires 36 and 38 which extend over onto the respective lower and upper sides 44 and 42. The contact wires 36 and 38 are still in the vicinity of the opposite lateral ends 46 and 48 but are spaced inwardly of the contact wires 34 and 40.

Either contact wire 18 or contact wire 20 may serve as the ground contact for the single filament within the lamp bulb 10. The contact wires 34 and 36, which are near the lateral end 46 of the wedgebase 32, are connected to the primary and secondary filaments in the dual filament lamp bulb 12 respectively. The contact wires 38 and 40 which are near the opposite lateral end 48 are connected to the secondary and primary filaments respectively. Thus either contact wire 34 or contact wire 40 may serve as the ground contact for the primary filament within the lamp bulb 12.

The common ground terminal 14 is designed to engage either a single contact wire, such as the contact wire 18 or contact wire 20 of the single filament lamp bulb 10, or one of a pair of laterally spaced contact wires on opposite sides of the wedgebase, such as the contact wire 34 of the pair of contact wires 34 and 36 or the contact wire 40 of the pair of contact wires 38 and 40 of the dual filament lamp bulb 12.

The common ground terminal 14 comprises a base plate 50 which has a pair of vertically spaced support tabs 52 which are integrally connected to opposite longitudinal side edges of the base plate 50. The common ground terminal further comprises a pair of opposed, upper and lower spring contact arms 54 and 56 which are integrally attached to lateral side edges of the respective vertically spaced support tabs 52 and extend forwardly in cantilever fashion. The spring contact arms 54 and 56 converge toward each other in the forward direction so as to biasingly engage opposite sides of the wedgebase 16 or 32 when either wedgebase is inserted into the space between the spring arms 54 and 56 as shown in FIGS. 2, 3, 4 and 5.

The lower spring contact arm 56 is in the form of a compound spring which has a second spring tab 58 which is formed out of the inward part of the spring contact arm 56 which is adjacent to the base plate 50. The spring tab 58 extends rearwardly toward the support tab 52 and converges toward the upper spring contact arm 54 in the rearward direction.

Figure 2:
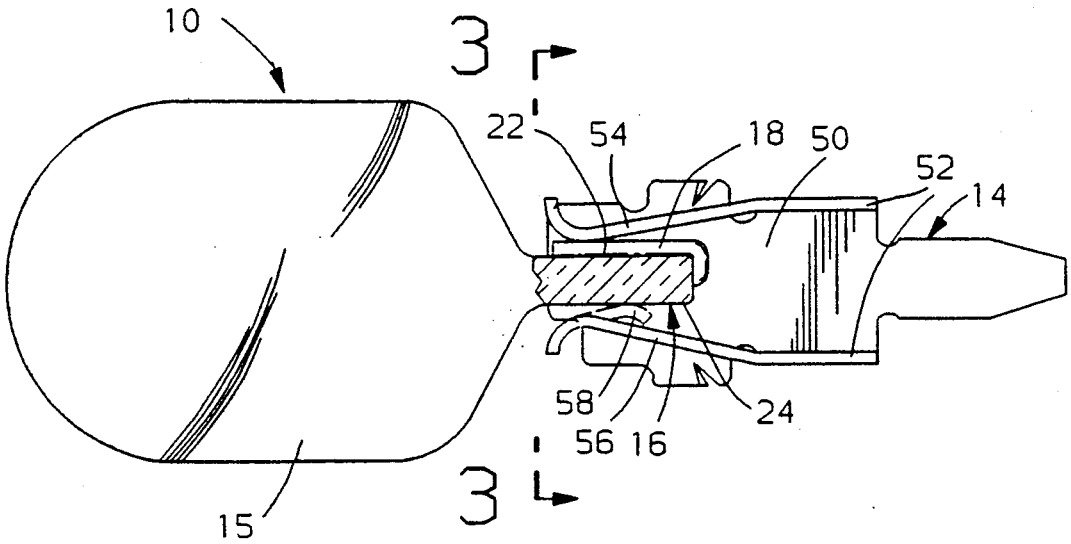
FIG. 2 is a longitudinal view of the common ground terminal attached to the wedgebase of the single filament lamp bulb shown in FIG. 1.
Figure 3:
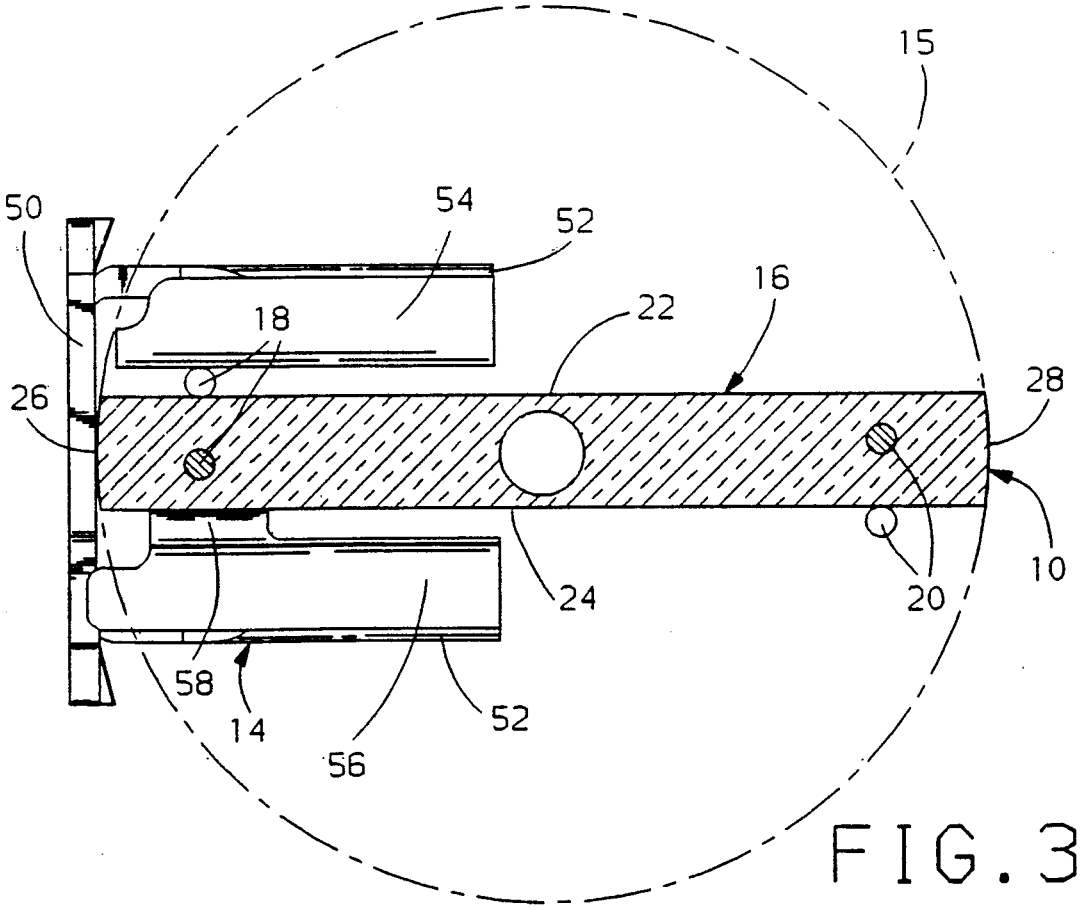
FIG. 3 is a section taken substantially along the line 3—3 of FIG. 2 looking in the direction of the arrow.

The spring tab 58 is designed sot that the common ground terminal 50 engages the ground contact wires of the wedgebases 16 and 32 with substantially the same contact force even though the contact area of the wedgebase 32 is thicker due to the presence of a second contact wire 36 or 38. The spring contact tab 58 accommodates the absence of the second contact wire as shown in FIGS. 2 and 3. More specifically, the contact tab 58 engages the lower side 24 of the wedgebase 16 which in turn deflects the lower spring arm 56 outwardly away from the lower side 24 by an amount which is about equal to the thickness of the contact wire 18 which is clamped between the upper spring contact arm 54 and the upper side 22 of the wedgebase 16. Consequently the upper and lower spring contact arms 54 and 56 are deflected outwardly substantially equal amounts (which are equal to a thickness of the contact wire for each) when the wedgebase 16 of the single filament lamp bulb 10 is inserted into the space between the spring contact arms. This applies a predetermined contact force of the ground terminal 14 to the contact wire 18 which can be maximized or preselected in accordance with the predictable deflection characteristics of the spring contact arms 54 and 56.

Figure 4:
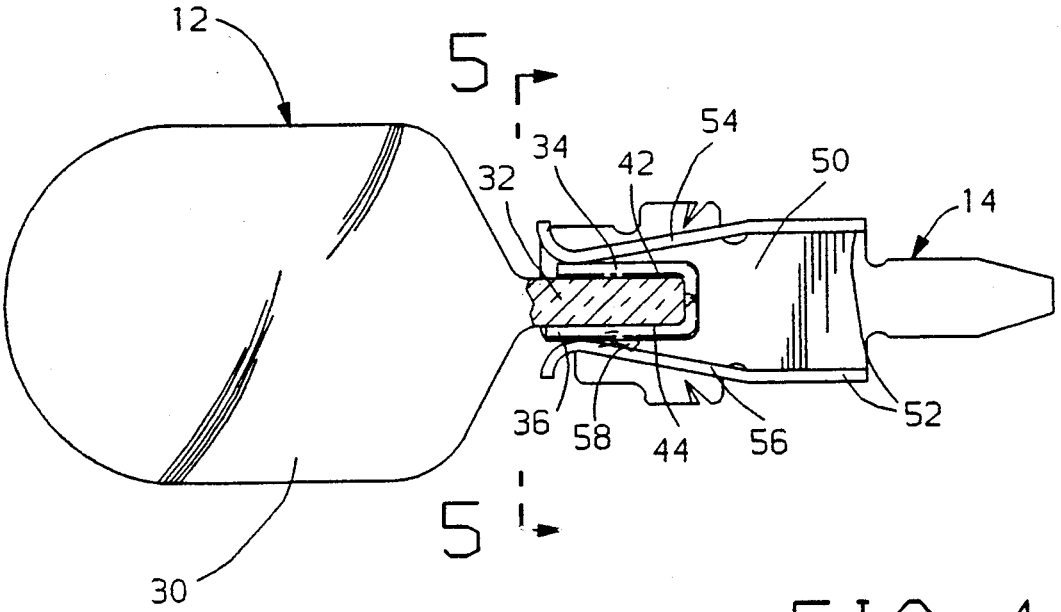
FIG. 4 is a longitudinal view of the common ground terminal attached to the wedgebase of the dual filament lamp bulb shown in FIG. 1.
Figure 5:
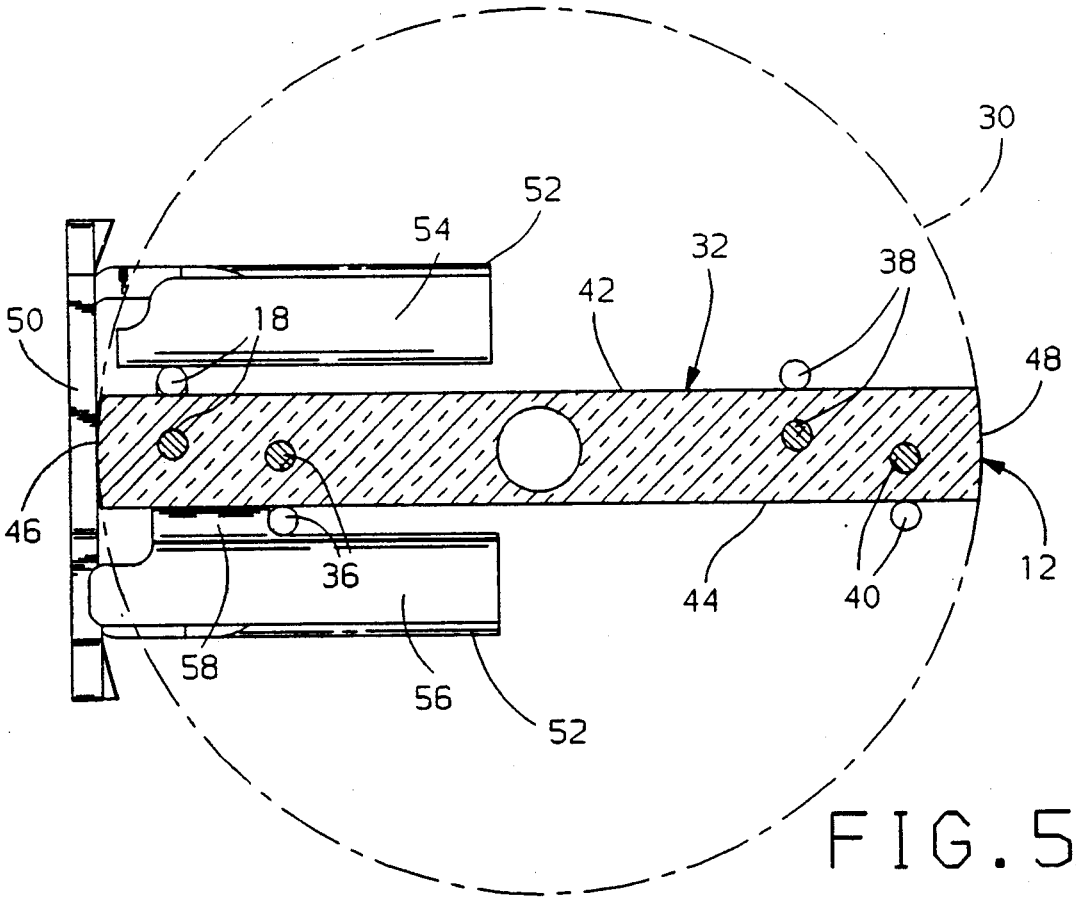
FIG. 5 is a section taken substantially along the line 5—5 of FIG. 4 looking in the direction of the arrow.

On the other hand, the lower spring contact arm 56 (that is, the outward portion next to the spring tab 58) accommodates the presence of the second contact wire 36 by providing a space for the second contact wire 36 when the spring tab 58 engages the lower side 44 when the wedgebase 32 of the dual filament lamp bulb 12 is inserted into the space between the upper and lower spring contact arms 54 and 56 as shown in FIGS. 4 and 5. In this instance the upper and lower spring contact arms 54 and 56 are still deflected outwardly by substantially the same equal amounts on each side of the wedgebase 32, that is, the thickness of the contact wire 18 on one side and the thickness of the contact wire 36 which is accommodated by the spring tab 58 on the other side. Consequently the common ground terminal 14 applies the same predetermined contact force to the ground contact wires regardless of whether the terminal 14 is used with the single filament lamp bulb 10 or the dual filament lamp bulb 12.

It should be noted that it is not necessary to establish electrical contact with the contact wires 36 or 38 because the single filament lamp socket has only one electrical feed which contacts either the contact wire 34 or the contact wire 40 when the dual filament lamp bulb 12 is inserted in a single filament lamp socket.

I wish it to be understood that I do not desire to be limited to the exact details of construction shown and described, for obvious modifications will occur to a person skilled in the art.

I claim:

1. A common ground terminal for use with either a single filament lamp bulb or a dual filament lamp bulb which has a wedgebase having contact wires emerging from an end of the base and extending over opposite sides of the wedgebase, the common ground terminal comprising:

a base plate which has a pair of vertically spaced support tabs which are integrally connected to opposite longitudinal side edges of the base plate;

the common ground terminal further having a pair of opposed, upper and lower spring contact arms which are integrally attached to lateral side edges of the respective vertically spaced support tabs and which extend forwardly from the support tabs in cantilever fashion;

the spring contact arms converging toward each other in the forward direction so as to biasingly engage opposite sides of a wedgebase when it is inserted into the space between the spring contact arms; and the lower spring contact arm being in the form of a compound spring which has a second spring tab which is formed out of the inner part of the lower spring arm which is adjacent to the base plate;

the spring tab extending rearwardly toward the support tabs and converging toward the upper spring contact arm in the rearward direction so as to engage one side of a wedgebase when it is inserted into the space between the spring contact arms and provide a space between the lower spring contact arm and the one side of the wedgebase to accommodate the presence of a contact wire on the one side of the wedgebase whereby the spring contact arms are deflected outwardly by substantially the same amount regardless of whether a single filament or a dual filament lamp bulb is being used.

2. A common ground terminal for use with either a single filament lamp bulb or a dual filament lamp bulb which has a wedgebase having contact wires emerging from an end of the base and extending over opposite sides of the wedgebase, the common ground terminal comprising:

a base plate which has a pair of vertically spaced support tabs which are integrally connected to opposite longitudinal side edges of the base plate;

the common ground terminal further having a pair of opposed, upper and lower spring contact arms which are integrally attached to lateral side edges of the respective vertically spaced support tabs and which extend forwardly from the support tabs in cantilever fashion;

the spring contact arms converging toward each other in the forward direction so as to biasingly engage opposite sides of a wedgebase when it is inserted into the space between the spring contact arms; and the lower spring contact arm being in the form of a compound spring which has a second spring tab which is formed out of the lower spring arm so as to engage one side of a wedgebase when it is inserted into the space between the spring contact arms and provide a space between the lower spring contact arm and the one side of the wedgebase to accommodate the presence of a contact wire on the lower side of the wedgebase whereby the spring contact arms are deflected outwardly by substantially the same amount regardless of whether a single filament or a dual filament lamp bulb is being used.

* * * * *